US009095243B2

(12) United States Patent
Ray et al.

(10) Patent No.: US 9,095,243 B2
(45) Date of Patent: Aug. 4, 2015

(54) WIPES DISPENSER WITH ANTI-ROPING AND ANTI-FALLBACK FEATURES

(75) Inventors: Eugene W. Ray, Barberton, OH (US); Keith A. Pelfrey, Wadsworth, OH (US)

(73) Assignee: GOJO Industries, Inc., Akron, OH (US)

( * ) Notice: Subject to any disclaimer, the term of this patent is extended or adjusted under 35 U.S.C. 154(b) by 980 days.

(21) Appl. No.: 13/032,889

(22) Filed: Feb. 23, 2011

(65) Prior Publication Data

US 2011/0139807 A1 Jun. 16, 2011

Related U.S. Application Data

(63) Continuation of application No. 12/388,777, filed on Feb. 19, 2009.

(51) Int. Cl.

| | |
|---|---|
| ***B65D 83/08*** | (2006.01) |
| ***A47K 10/38*** | (2006.01) |
| *A47K 10/32* | (2006.01) |

(52) U.S. Cl.

CPC ..... *A47K 10/3818* (2013.01); *A47K 2010/3206* (2013.01); *A47K 2010/3266* (2013.01)

(58) Field of Classification Search

USPC ..... 221/33, 36, 42, 47, 63, 64, 303

See application file for complete search history.

(56) References Cited

U.S. PATENT DOCUMENTS

2007/0199949 A1* 8/2007 Simkins ..... 221/63

* cited by examiner

*Primary Examiner* — Gene Crawford
*Assistant Examiner* — Kelvin L Randall, Jr.
(74) *Attorney, Agent, or Firm* — Renner Kenner Greive Bobak Taylor & Weber

(57) ABSTRACT

A wipes dispenser includes a container having an interior holding a plurality of wipes. A grip orifice provides communication between the interior and the exterior of the container, and the grip orifice serves to prevent wipes from falling back into the interior. The dispenser also includes a rip fence, and a lead end of a lead wipe of the plurality of wet wipes within the container extends through the grip orifice and then through the rip fence such that pulling on the lead end to pull the lead wipe against the rip fence causes the remainder of the lead wipe to be removed from the container and become disassociated with the remaining wipes of the plurality of wipes. As the lead end is pulled against the rip fence, the following wipe of the plurality of wipes is pulled through the grip orifice to provide its lead end outside of the interior of the container, and the grip orifice prevents this lead end of the following wipe from falling back into the interior of the container.

5 Claims, 8 Drawing Sheets

WIPES DISPENSER WITH ANTI-ROPING AND ANTI-FALLBACK FEATURES

CROSS-REFERENCE TO RELATED APPLICATION

This application is a continuation of U.S. patent application Ser. No. 12/388,777 filed on Feb. 19, 2009, the contents of which are incorporated herein by reference.

FIELD OF THE INVENTION

The present invention generally relates to wipes dispensers. More particularly, the present invention relates to wipes dispensers having anti-fallback and anti-roping features. In a particular embodiment, this invention also provides a wipes dispenser with lid features serving to prevent the drying out of wet wipes held within the dispenser.

BACKGROUND OF THE INVENTION

Wipes dispensers are now in widespread use to provide individual wipes for various applications. Wipes dispensers typically include a container holding a plurality of wipes to be dispensed through an aperture in the container. The containers may be rigid plastic containers or flexible containers, for example, those made out of foil materials. The plurality of wipes may be provided on a roll, with individual wipes being defined between perforations in the roll, much like a roll of paper towels. The plurality of wipes might also be provided as individual wipes interleaved together, much like a common box of tissues. The perforated roll and interleaved structures are advantageous in that pulling a lead wipe through a dispensing aperture in the container will cause another wipe to follow such that, once the lead wipe is removed and separated from the following wipe, the following wipe remains accessible at the exterior of the container to thereafter be removed when desired. This is all very well known.

In order for the lead wipe to be separated from the following wipe, it is important that the following wipe be subjected to some type of resistance so that the lead wipe can be ripped off of the remainder at its perforations (in the case of a perforated roll of wipes) or disengage from being interleaved with the following wipe (in the case of an interleaved stack of wipes). Thus, a large number of different dispensing orifices exist in the prior art to provide resistance to the removal of wipes from a container. In some prior art embodiments, star-shaped or other specially-shaped apertures are provided so that, when a leading wipe is pulled through the aperture, particularly on an angle off of vertical, the special shape of the aperture serves to provide resistance to the following wipe, with the resistance intended to be sufficient for causing the separation of the lead wipe from the following wipe. In other embodiments, the aperture is provided as a slit in an elastomeric element, with the slit providing resistance to the pulling of the wipes out of the container. Notably, in accordance with the present invention, any type of grip orifice currently employed or hereinafter developed will be suitable for practicing the present invention.

These grip orifices of the prior art are provided to (a) separate individual wipes from a perforated web or interleaved stack of wipes, and (b) hold the lead wipe in such a manner that it is easily accessed for dispensing, when desired. That is, the grip orifice not only serves to separate a lead wipe from a following wipe but also to prevent the lead wipe from falling back into the container, where the user would then have to take steps to access the interior of the container in order to access the wipe. However, it is well known that the dispensing orifices of the prior art often times fail to separate a lead wipe from a following wipe, allowing what is herein termed a "roping" of the plurality of wipes. Roping occurs when separation is not achieved and multiple wipes are pulled from the container as a continuous string or rope. This leads to waste and is simply not acceptable to the end user. When the dispensing orifice does successfully separate a lead wipe from a following wipe it serves what is termed herein an "anti-roping" function.

It is also well known that the dispensing orifices of the prior art often times cause a lead wipe to be separated from a following wipe too early, before the lead end of the following wipe has passed out of the interior of the container and through the dispensing orifice, allowing the following wipe to fall back into the interior of the container. When this occurs, the following wipe remains inside the container, which must then be opened to access the wipes. The dispensing orifice thereby fails to serve what is termed herein as an "anti-fallback" function.

Thus, those familiar with the prior art will readily appreciate that the grip orifices do not always serve the anti-fallback and anti-roping functions. Indeed, it is quite common for the average user to pull more than one wipe from the interior of the container because the grip orifice has failed to separate a line of perforation or even an interleaved connection. It is also common for the grip orifice to disconnect the wipes in such a way that the following wipe remains under the grip orifice and is not exposed at the exterior of the container, thus requiring the user to access the interior of the container to access the wipe. Quite simply, the grip orifices of the prior art fail to adequately perform both the anti-roping and anti-fallback features for which they are intended. The present invention seeks to provide a wipes dispenser having structures sufficient to provide both anti-roping and anti-fallback functions.

SUMMARY OF THE INVENTION

In at least one embodiment, the present invention provides a wipes dispenser including a container having an interior holding a plurality of wipes. The dispenser includes a grip orifice that provides communication between the interior and the exterior of the container, and the grip orifice serves to prevent wipes from falling back into the interior. The dispenser also includes a rip fence, and a lead end of a lead wipe of the plurality of wet wipes within the container extends through the grip orifice and then through the rip fence such that pulling on the lead end to pull the lead wipe against the rip fence causes the remainder of the lead wipe to be removed from the container and become disassociated with the remaining wipes of the plurality of wipes. As the lead end is pulled against the rip fence, the following wipe of the plurality of wipes is pulled through the grip orifice to provide its lead end outside of the interior of the container, and the grip orifice prevents this lead end of the following wipe from falling back into the interior of the container.

Thus, this invention advances the art by providing separate structures for anti-roping and anti-fallback functions. The grip orifice serves the anti-fallback function, while the rip fence serves the anti-roping function. In particular embodiments, a lid is provided to selectively cover and uncover the grip orifice and rip fence elements. In instances when the wipes are wet wipes impregnated with some type of fluid, the lid preferably includes a sealing member such that, when the lid is closed over the grip orifice, a lead end of the wipe held by the grip orifice and outside of the interior of the container is sealed off from the atmosphere to minimize dry out.

This invention also provides a method for dispensing a lead wipe of a plurality of wipes from within a wipes dispenser. The method includes the steps of providing a wipes dispenser including: a container having an interior holding a plurality of interconnected wipes interconnected by means selected from the group consisting of lines of perforation and interleaved connections; a grip orifice extending through a feed surface of the container, the grip orifice providing communication between the interior and the exterior of the container; a lead wipe of the plurality of interconnected wipes extending through the grip orifice to present a lead end of the lead wipe at the exterior of the container; and a rip fence separate and distinct from the grip orifice. The rip fence includes: a body member extending from the feed surface of the container at a location distanced from the grip orifice; and an aperture in the body member, the aperture defining a tear geometry, wherein the lead end of the lead wipe extends from the grip orifice through the aperture. Having provided such a wipes dispenser, the method is continued by pulling on the lead end of the lead wipe to pull the lead wipe through the aperture in the body member and further to pull the lead wipe against the tear geometry at the point of interconnection of the lead wipe to a following wipe, said step of pulling thereby causing the remainder of the lead wipe to be removed from the container along with a lead end of the following wipe and further causing the lead wipe to be disassociated from the following wipe with the following wipe providing its lead end outside of said interior of said container.

BRIEF DESCRIPTION OF THE DRAWINGS

FIG. 7 is a side elevation view of the third embodiment of FIG. 5, showing the rip fence pivoted for easy threading of a wipe there through;

DETAILED DESCRIPTION OF ILLUSTRATIVE EMBODIMENTS

Figure 1:
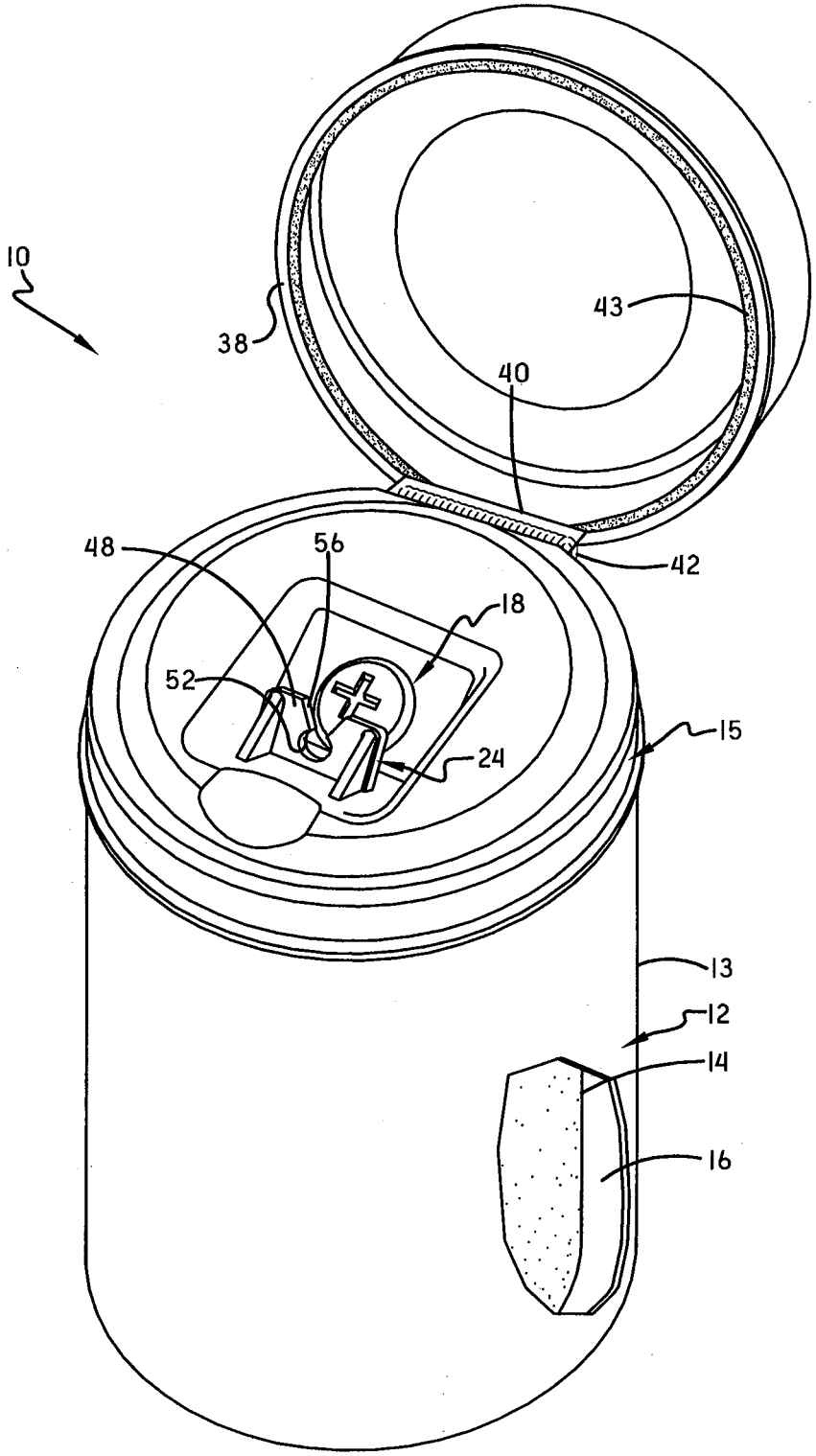
FIG. 1 is a perspective view of a first embodiment of the present invention.
Figure 2:
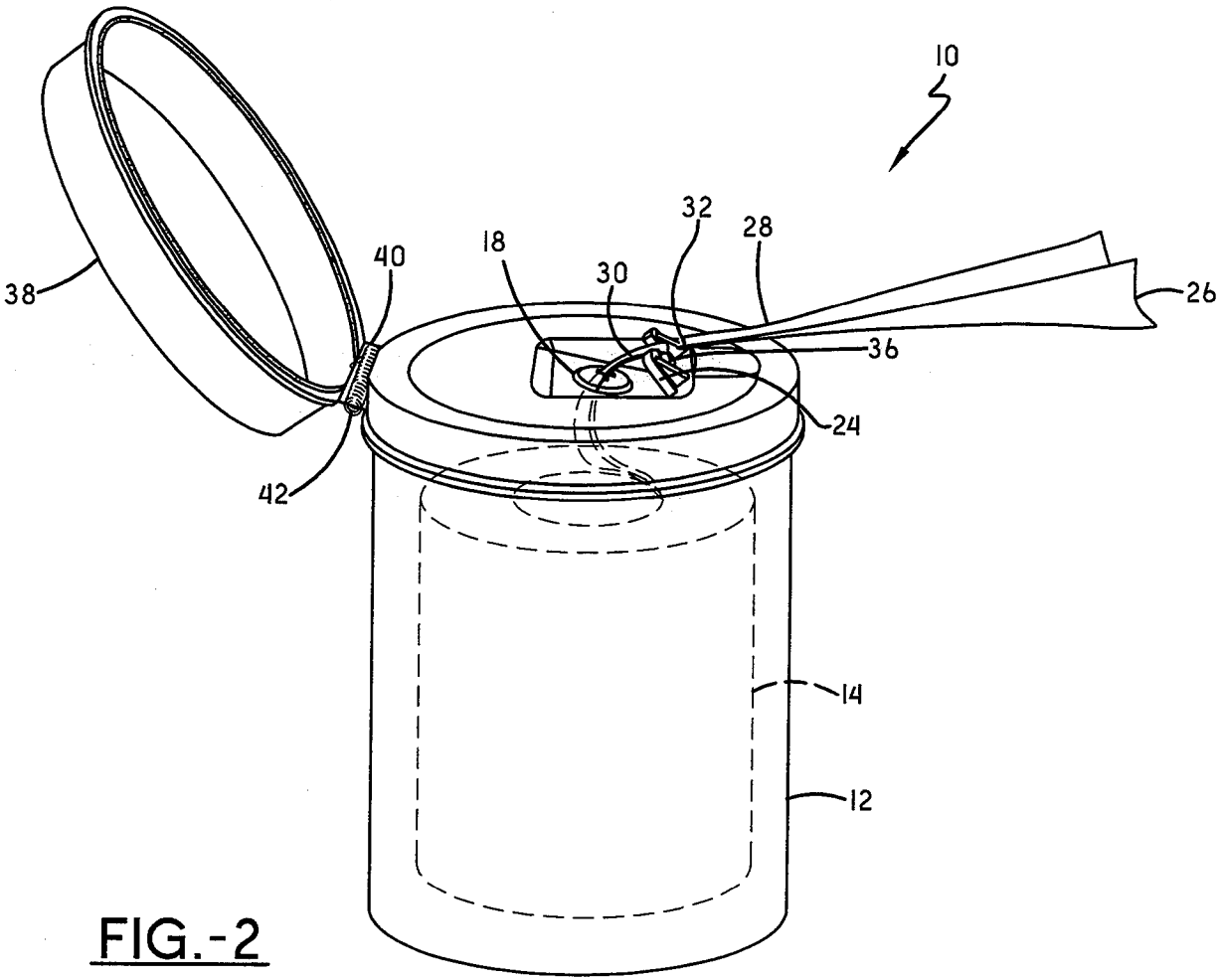
FIG. 2 is a side view of the wipes dispenser of FIG. 1, shown as a lead wipe is being removed/dispensed.

Referring now to FIGS. 1 and 2, a first embodiment of wet wipes dispenser in accordance with this invention is shown and designated by the numeral 10. The wipes dispenser 10 includes a container 12 holding a roll of wipes 14. It should be appreciated that although the container 12 is shown as a bucket-type container, it may take virtually any form, and can even be a flexible container, as evidenced by the embodiment of FIG. 7 disclosed herein below. Similarly, the roll of wipes 14 can be replaced by virtually any plurality of wipes wherein individual wipes are associated in such a way that a following wipe follows a lead wipe as it is removed from the container.

The roll of wipes 14 is held in the interior 16 of the container 12, which, in this embodiment, is defined by a sidewall 13 and a lid 15 removably joined to the sidewall 13. A grip orifice 18 in the lid 15 provides communication between the interior 16 and the exterior of the container 12. The grip orifice 18 can be virtually any known or hereafter developed grip orifice, and those of ordinary skill in the art will readily appreciate that there are a multitude of grip orifice types that would be suitable for this invention. For this invention, a grip orifice 18 should impart enough resistance to the movement of a wipe there through so as to hold the wipe and prevent it from falling back into the container if released. The grip orifice 18 should also be designed such that the resistance it imparts is not enough to tear the wipe or cause it to be disassociated with the remainder of the wipes on the roll of wipes 14 (or with the remainder of the wipes in an interleaved stack, if such a stack is employed).

Figure 9:
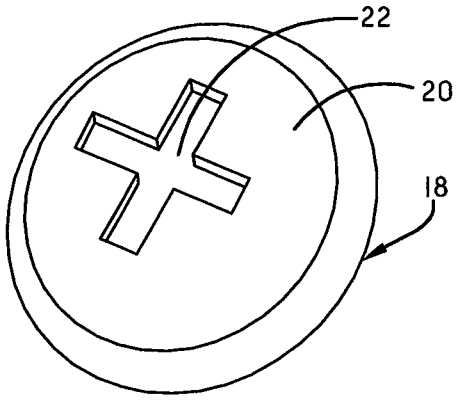
FIGS. 9-11 are top plan and perspective views of different grip orifices, shown as examples and with no intention to limit the invention to such orifices.
Figure 10:
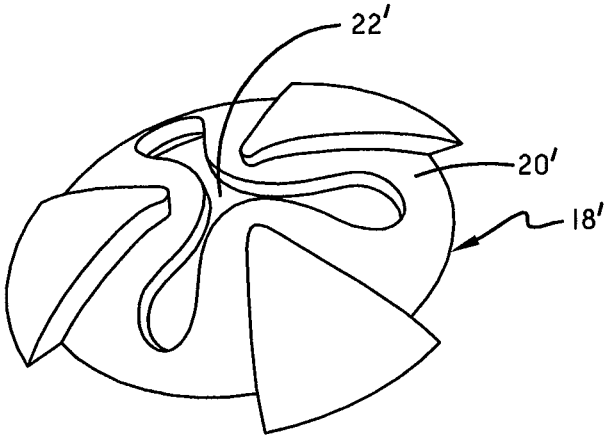
Figure 11:
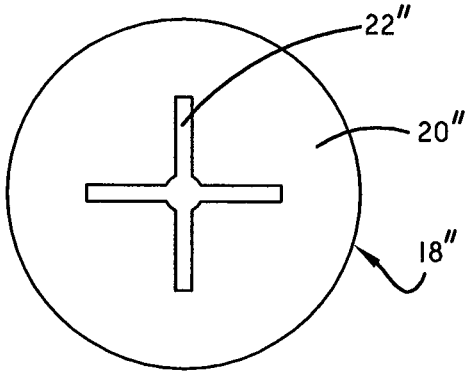

A particularly desired grip orifice 18 is shown in FIG. 9, and is an elastomeric body 20 having a cross slit 22 therein. Thermoplastic elastomers (TPE's) and silicone are non-limiting examples of suitable materials for elastomeric body 20. The resilient property of such a body serves to grip a wipe at the narrow passage defined by the cross slit 22. This grip orifice 18 is particularly preferred because, when the wipes are chosen to be wet wipes impregnated with a fluid, the elastomeric grip orifice will serve to prevent the roll of wet wipes in the interior 18 of the container 12 from drying out. With reference to FIGS. 10 and 11 it can be seen that other grip orifices, labeled as 18' and 18", with particular body structures 20' and 20" with slits 22' and 22" could also be employed, by way of example only, it again being stressed that virtually any grip orifice currently known or hereinafter developed could be employed in accordance with the concepts of this invention. The embodiments of FIGS. 9 and 10 are formed of more rigid materials, for example, polypropylene or low density polyethylene or other polyolefins, and are formed to be very thin proximate the slits therein such that, though rigid, they bend and flex at the slits 22', 22". The body structures 20' and 20" are, in some embodiments, less than 0.008 inches thick proximate their respective slits 22' and 22", and, in other embodiments, less than 0.006 inches thick, and, in yet other embodiments, less than 0.004 inches thick.

In the embodiment of FIG. 1, a rip fence 24 is positioned proximate the grip orifice 18. The rip fence 24 is provided for the purpose of separating a lead wipe from a following wipe, as the lead wipe is pulled from the container 12, for use. As seen in FIG. 1, a lead end 26 of a lead wipe 28 extends through the grip orifice 18 and then through the rip fence 24. Pulling on the lead end 26 in such a manner that the lead wipe 28 is pulled against the structure of the rip fence 24 causes the remainder of the lead wipe 28 to be removed from the container 12 and become disassociated with a following wipe 30. More particularly, when the area of association between the lead wipe 28 and the following wipe 30 is pulled against the rip fence 24, that area of association will be broken, disassociating the lead wipe 28 from the following wipe 30. In this particular embodiment, the area of association is characterized by perforations 32 in a web of wipes, and when those perforations are pulled against the rip fence 24, the lead wipe 28 is removed from the following wipe 30 along the line of perforation. It should be appreciated, however, that the area of association could also exist as an area of overlap between interleaved wipes in an interleaved stack, or as perforations between wipes joined in an interleaved stack. Because the rip fence 24 is distanced from the grip orifice 18 and further because the grip orifice 18 is not suitable for disassociating a lead wipe from a following wipe 30, a suitable length of the following wipe 30 is left behind for access by the user. More particularly, the following wipe 30 becomes the new lead wipe once the previous lead wipe 28 is disassociated with the plurality of wipes provided by the roll of wipes 14.

Notably, the lead end 26 of the lead wipe 28 is pulled to rake across the structure of the rip fence 24. When perforations or interleaved connections are pulled against the rip fence 24, enough resistance is provided to disassociate the lead wipe from the following wipe. Here, the rip fence 24 includes a body member 48 having a slot feed 56 leading to a narrow tear geometry 52. In order to remove the lead wipe 28 from the container 12 and disassociated it from the roll of wipes 14, the lead wipe 28 may be pulled along directions in which the lead wipe 28 and following wipe 30 are pulled against the tear geometry 52 of the rip fence 24. With the tear geometry structure shown in FIGS. 1 and 2, having an open top at slot feed 56, the lead wipe 28 is to be pulled horizontally or even slightly downwardly. If the lead end 26 of the lead wipe 28 is pulled in a different direction, it is less likely the rip fence 24 will provide enough resistance to separate the lead wipe 28 from the following wipe 30 inasmuch as the lead wipe 28 and following wipe 30 would be less likely to rake against the tear geometry 52. Wipes should be pulled to rake against the tear geometry provided or else a plurality of wipes may be pulled from the interior 16 of the container 12 contrary to the desired anti-roping function. Notably, the grip orifice 18 defines a fixed position for withdrawal of a wipe from the container 12, and it is the relationship between this fixed point and the threading of the lead wipe 28 through the rip fence 24 and the direction in which the lead end 26 is pulled that causes the lead wipe 28 and following wipe 30 to be pulled against the rip fence 24. A pressure point designated by the numeral 36 is created by the contact between the wipe and the rip fence 24.

Although it is not absolutely necessary, a lid cap 38 is preferably provided on the lid 15 of container 12 to close over the grip orifice 18. This is particularly preferred when the wipes are wet wipes impregnated with a fluid. The lid 38, when closed over the grip orifice 18 and any length of wipe held by the grip orifice 18, will serve to prevent the wet wipe from quickly drying out. The lid 38 will also prevent the remainder of the roll of wipes 14 from drying out. Thus, a lid 38 is preferably provided on a hinge 40 so that the lid 38 can pivot between an open position, as shown in FIG. 1, and a closed position, which is easily appreciated in FIG. 1 though not shown. Notably, the lid 38 would also close over the rip fence, although that is not necessary in that it is mainly important for the lid 38 to cover the grip orifice 18 to close off the communication between the interior 16 of the container 12 and the atmosphere. In a particularly preferred embodiment, the lid 38 is biased by a spring 42 or other biasing element such that the normal resting position for the lid 38 is the closed position. With such a biasing mechanism, it would no longer be necessary for the user to take active steps to close the container 12 after use to prevent dry out. The lid 38 preferably carries a seal 43 to seal against the container 12 when dry out is a concern.

Figure 3:
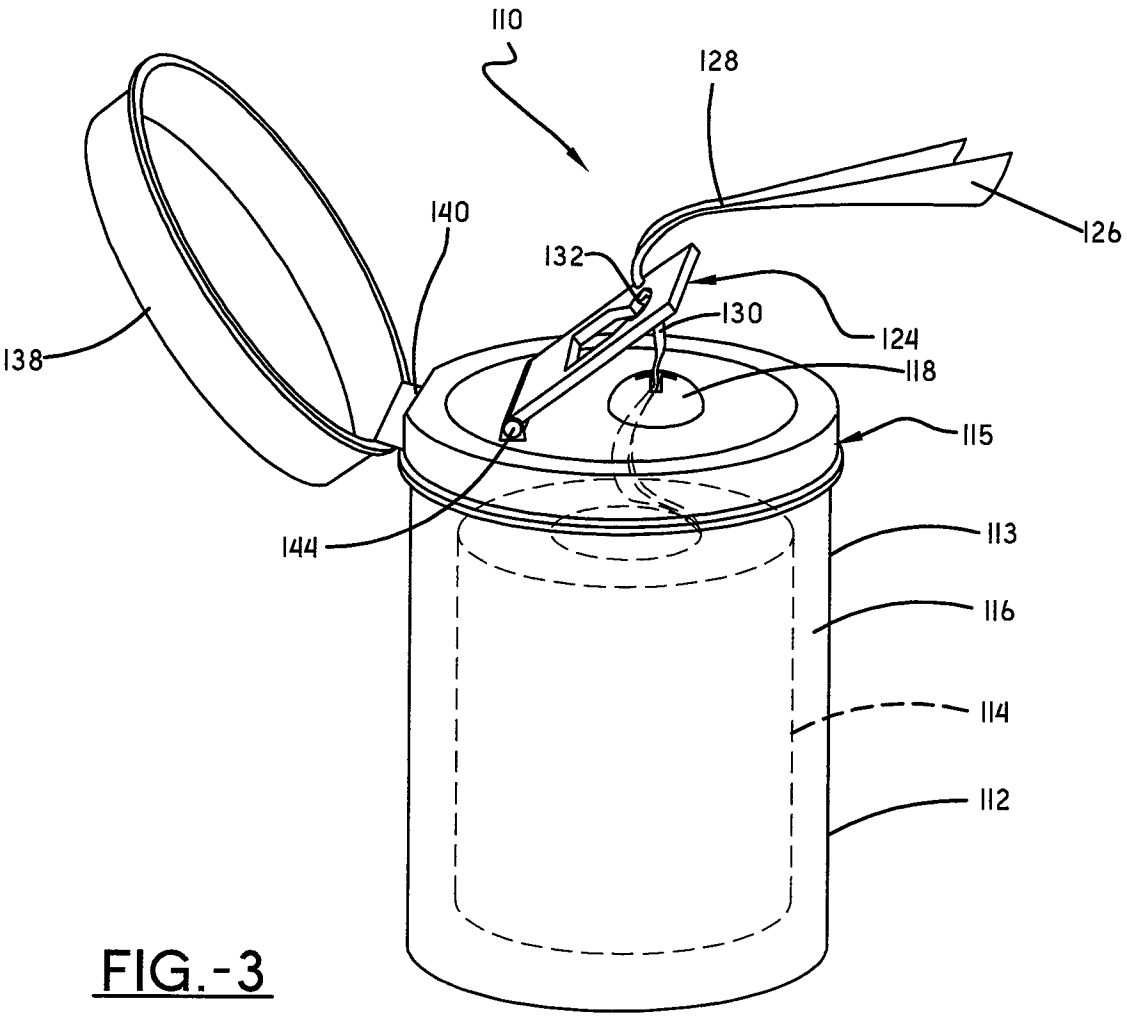
FIG. 3 is a perspective view of a second embodiment of the present invention, providing a pivoting rip fence.
Figure 4:
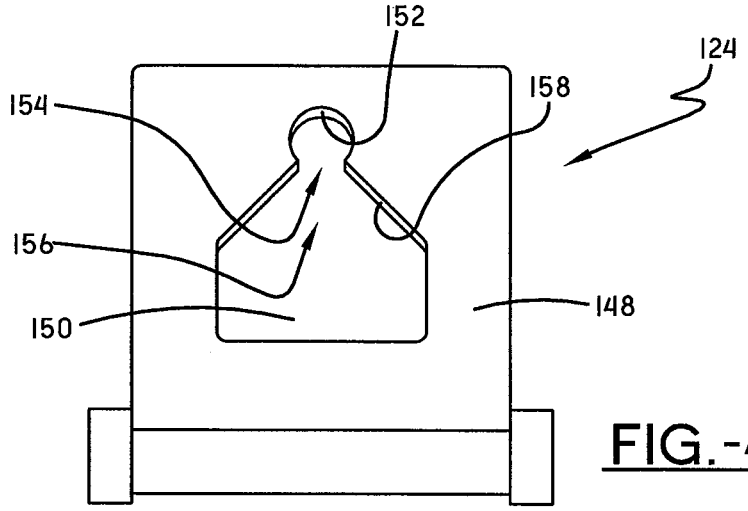
FIG. 4 is a front elevation of the rip fence of the second embodiment.
Figure 5:
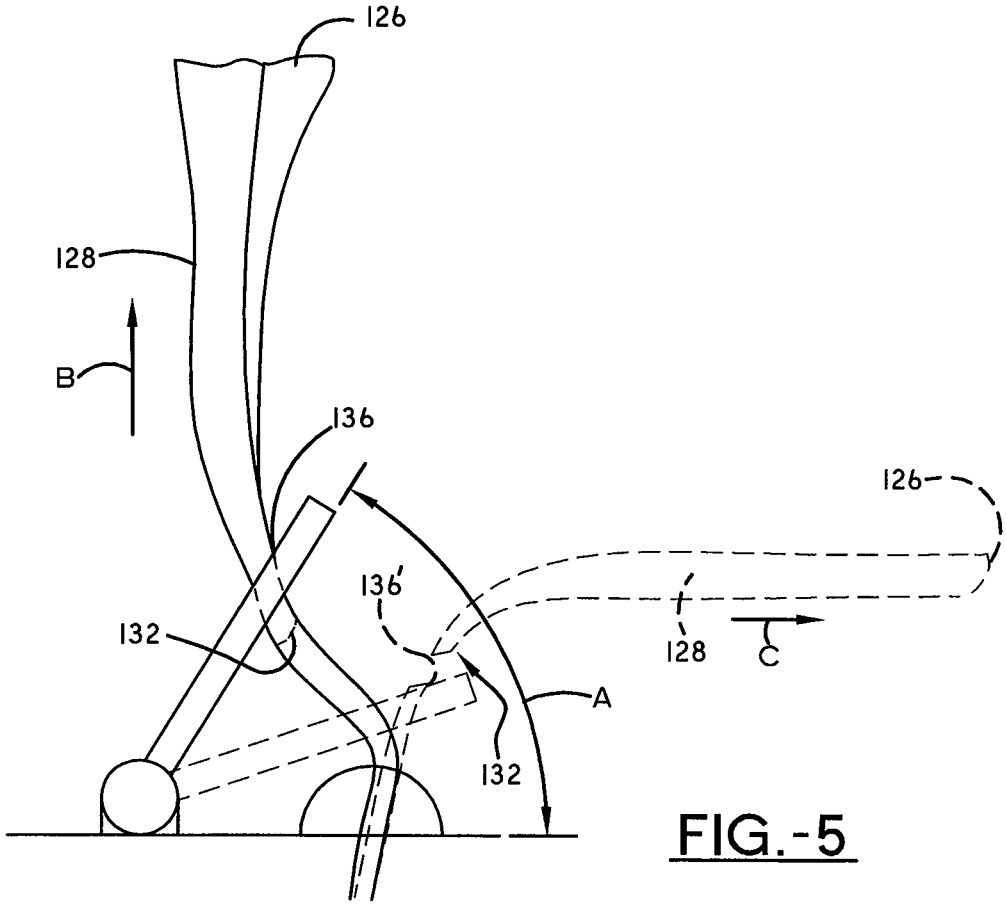
FIG. 5 is a side plan view of the grip orifice, rip fence and lid elements of the second embodiment of FIG. 3.

Referring now to FIGS. 3-5, a second embodiment of a wipes dispenser in accordance with this invention is shown and designated by the numeral 110. The wipes dispenser 110 includes a container 112, defined by a sidewall 113 and a removable lid 115. A roll of wipes 114 is retained in the interior 116 of the container 112. A grip orifice 118 is provided to provide communication between the interior 116 and the atmosphere. A lid cap 138 is provided, substantially as disclosed above with respect to the embodiment of FIG. 1, and a rip fence 124 is positioned between the lid cap 138 and the grip orifice 118. The rip fence 124 is pivotally secured to the container 112 at a hinge 144. Although it will be appreciated that the wipes dispenser 110 will function sufficiently without such a structure, the rip fence 124 is pivotally secured to the container 112 at hinge 144 at a position such that the rip fence 124 can pivot to extend over the grip orifice 118. Although not necessary, in some embodiments, the ripe fence 124 is biased by a spring (e.g., torsion spring, not shown, but similar to that shown at spring 42 of FIGS. 1 and 2) or similar biasing mechanism to remain at the angle shown in FIG. 2, absent any pressure on the rip fence 124 to move it to a different position. For example, the lid 138 pivotally secured to the container 112 at a hinge 140, could be pressed downwardly to close over the rip fence 124 and the grip orifice 118 and, when it contacts the rip fence 124, would push the rip fence 124 against the bias of the spring 144. The hinge 140 could also include a spring, as already shown and disclosed with respect to the embodiment of FIGS. 1 and 2.

A lead end 126 of a lead wipe 128 is threaded through the grip orifice 118 and the rip fence 124, and the wipes dispenser 110 functions substantially as already described with respect to the embodiment of FIG. 1. However, in this embodiment, the rip fence 124 pivots. The grip orifice 118 still provides a fixed position for withdrawal of the wipes from the container 112, but the tear geometry of the rip fence 124 can assume a ripping orientation with respect to that fixed position anywhere along an arc about the pivot point defined by the hinge 144. More particularly, with reference to FIG. 4, the rip fence 124 includes a body member 148 having an aperture 150 therein. This aperture 150 defines a tear geometry generally identified by the number 152. In this embodiment, the tear geometry 152 is a narrow wipe slot 154, and a slot feed 156 is formed by means of sloped sides 158 of the aperture 150 leading to the wipes slot 154. With this structure, a wipe threaded into the aperture 150 will automatically be urged into the wipe slot 154 when pulled in a direction that pulls the wipe against the slot feed 156.

With reference to FIG. 5, it can be seen that a lead end 126 of a lead wipe 128 can be pulled in any direction along an arc A and yet still be pulled against the slot feed 156. If the wipe were pulled in a direction outside of this arc it is more likely that the wipe would not feed into the wipe slot 154. In this embodiment of FIGS. 3-5, the rip fence 124 pivots at a hinge 144 positioned between the grip orifice 118 and the hinge 140 of the lid cap 138, and the lid cap 138 is designed to open to a maximum angle of less than 135 degrees off of the horizontal plane; in other embodiments less than 90 degrees; in others less that 80, and in yet others less than 70 degrees. When the lid cap 138 is limited to open to such angles, a user is urged to pull a wipe in a direction along the arc A, since it is difficult to pull the wipe in another direction due to the presence and interference of the lid cap 138. Thus, the lid cap 138, in its open position, serves to preclude the pulling of a wipe in a direction where the tear geometry 152 would be ineffective. As with the prior embodiment, lid cap 138 preferably carries a seal when dry out is a concern.

With reference to FIGS. 3 and 5, it will be appreciated that pulling on the lead end 126 in such a manner that the lead wipe 128 is forced into and pulled against the tear geometry 152 of the rip fence 124 causes the remainder of the lead wipe 128 to be removed from the container 112 and become disassociated with the following wipe 130. More particularly, when the area of association between the lead wipe 128 and the following wipe 130 is pulled against the tear geometry 152, that area of association will be broken, disassociating the lead wipe 128 from the following wipe 130. In this particular embodiment, the area of association is characterized by perforations 132 in a web of wipes, and, when those perforations are pulled against the tear geometry 152, the lead wipe 128 is removed from the following wipe 130 along the line of perforation. It should be appreciated, however, that the area of association could also exist as an area of overlap between interleaved wipes in an interleaved stack or as perforated between wipes joined in an interleaved stack. Because the rip fence 124 is distanced from the grip orifice 118 and further because the grip orifice 118 is not suitable for disassociating a lead wipe 128 from a following wipe 130, a suitable length of the following wipe 130 is left behind for access by the user. More particularly, the following wipe 130 becomes the new lead wipe once the previous lead wipe 128 is disassociated with the plurality of wipes provided by the roll of wipes 114.

Notably, with reference to FIG. 5, the grip orifice 118 defines a fixed position for withdrawal of a wipe from the container 112, and it is the relationship between this fixed point and the threading of the lead wipe 128 through the rip fence 124 and the direction in which that lead end is pulled that causes the lead wipe 128 and following wipe 130 to be pulled into and against the tear geometry 152. Thus, the tear geometry 152 can assume a ripping orientation with respect to the fixed position established by the grip orifice 118 along the arc A about the pivot point 144. As seen in FIG. 5 and shown by way of example, pulling the lead end 126 of a lead wipe 128 in the direction of arrow B causes the rip fence 124 to pivot and place the tear geometry 152 at a ripping orientation that is establishes a pressure point 136, while pulling the lead end 126 of a lead wipe 128 in the direction of arrow C causes the rip fence 124 to pivot to a position placing the tear geometry 152 at a ripping orientation establishing a pressure point 136'.

Figure 6:
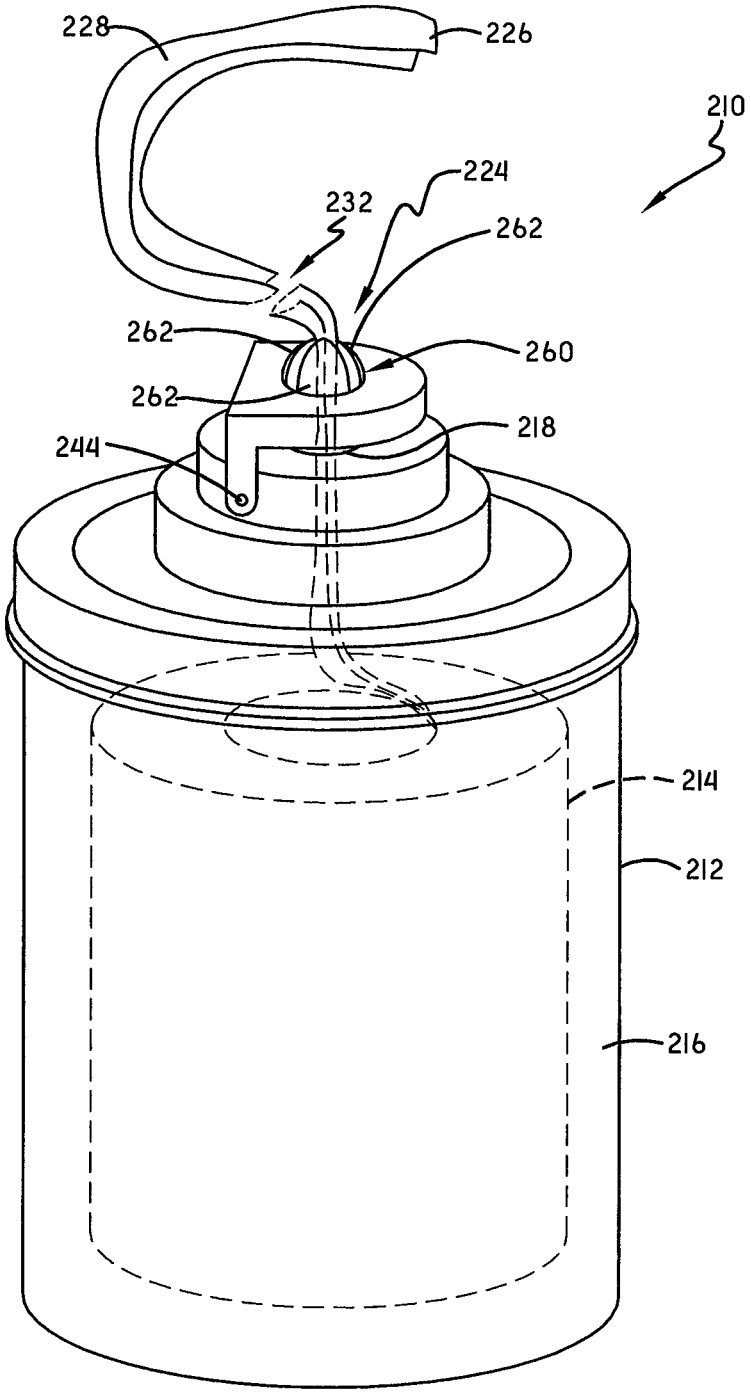
FIG. 6 is a perspective view of a third embodiment of the present invention, having a rip fence comprised of a thimble of flexible fingers.
Figure 7:
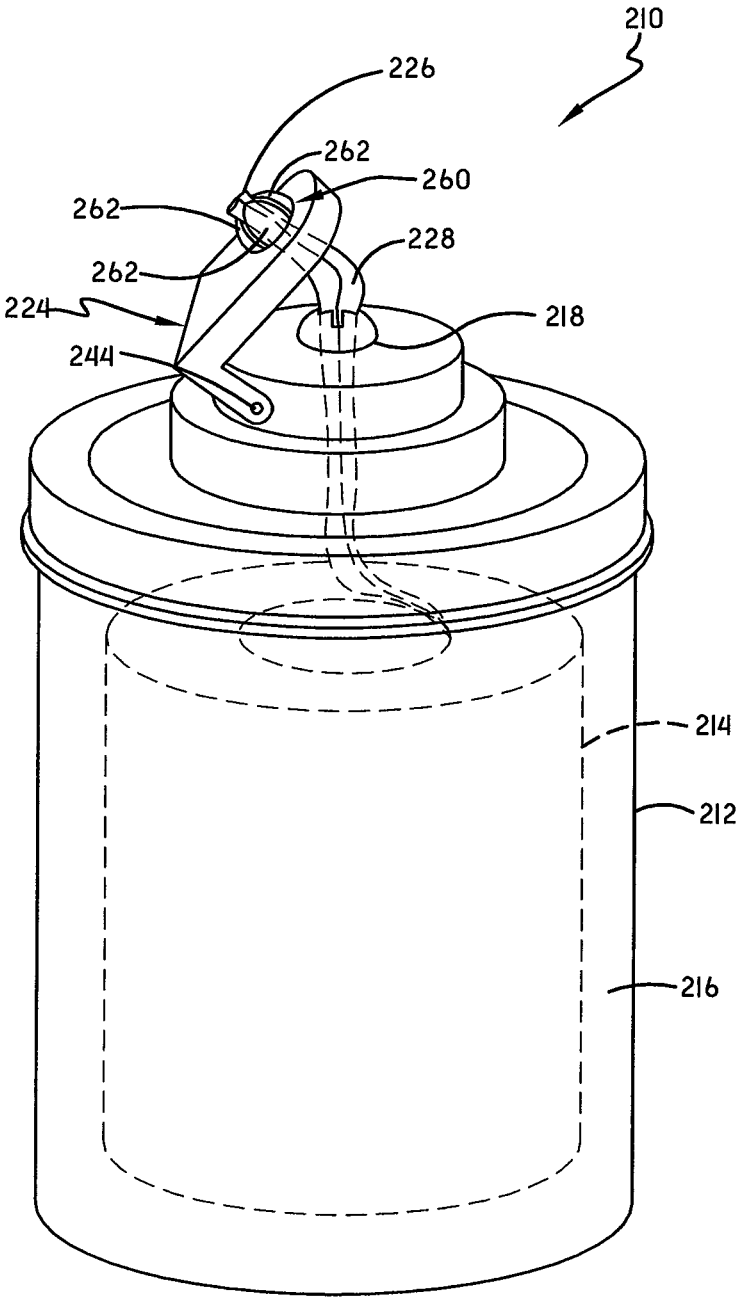

Referring to now FIGS. 6 and 7, yet another embodiment of a wipes dispenser in accordance with this invention is shown and designated by the numeral 210. The wipes dispenser 210 includes a container 212 holding a roll of wipes 214 in the interior 216 of the container 212. A grip orifice 218 is provided to provide communication between the interior 216 and the atmosphere. A rip fence 224 is positioned proximate to the grip orifice 218 and is pivotally secured to the container 212 at a hinge 244. This rip fence 224 includes a thimble 260 formed of a plurality of flexible fingers 262, through which a lead end 226 of a lead wipe 228 may be threaded. As with prior embodiments, the grip orifice 218, while being sufficient to hold a wipe to prevent it from falling back into the interior 216 of the container 212, is not sufficient for separating the lead wipe 228 from the following wipe 230 along its area of association, which here is a line of perforation 232. It is the rip fence 224, and, more particularly, the thimble 260 of flexible fingers 262 that serves to separate a lead wipe 228 from a following wipe 230. As seen in FIG. 7, the rip fence 224 pivots at the hinge 244 so that the thimble 260 can be moved away from the grip orifice 218 to provide room so that a lead end 226 of a lead wipe 228 can be threaded through the rip fence 224 when necessary. Because the plurality of the flexible fingers 262 provide a restricted aperture sufficient to disassociate a lead wipe from a following wipe, and further because those fingers 262 surround the wipe being pulled the restricted aperture, this rip fence 224 is sufficient to separate a lead wipe from a following wipe regardless of the direction in which a wipe is being pulled.

Figure 8:
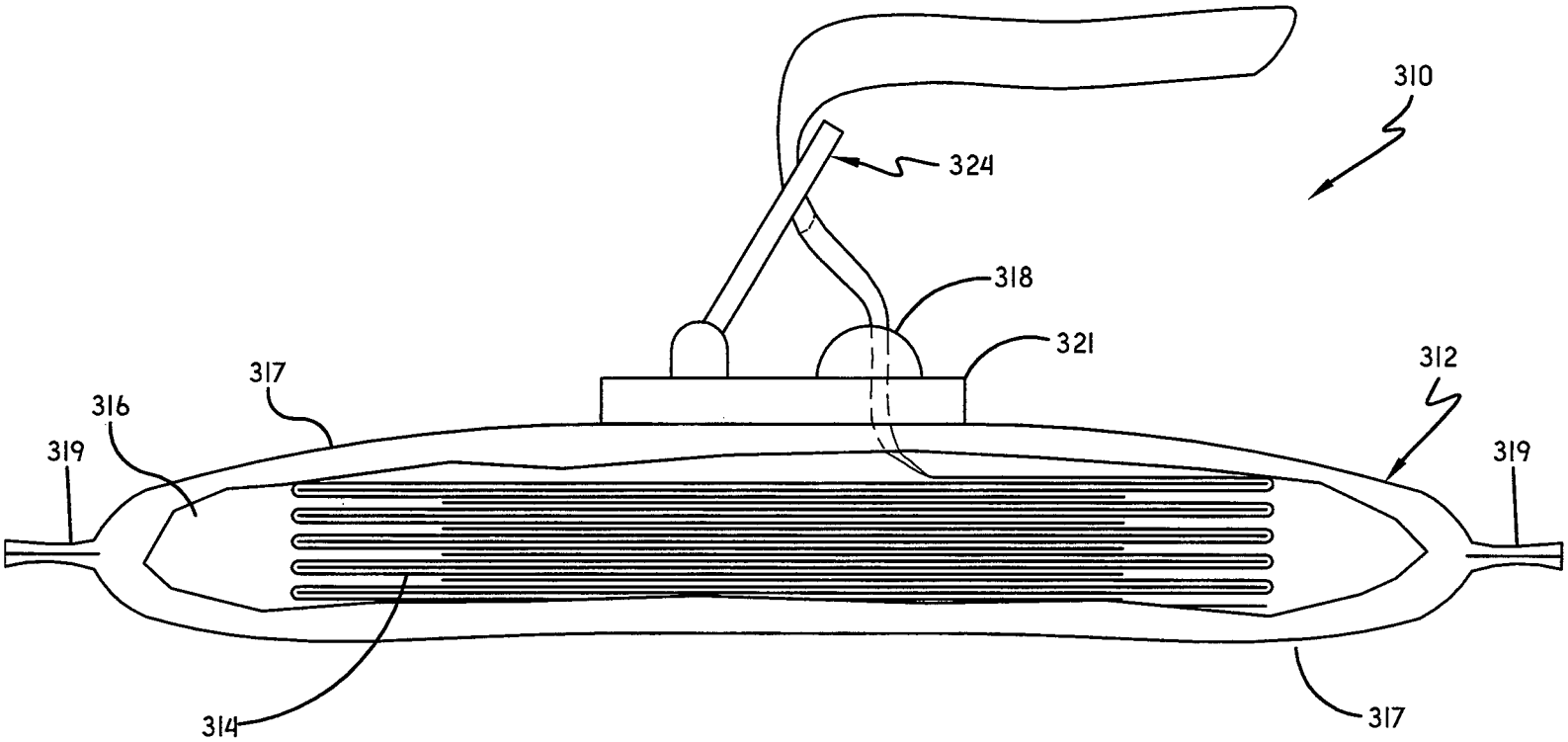
FIG. 8 is a side elevation view of a fourth embodiment of the present invention, showing use of a grip orifice and rip fence as part of a pouch-type container having flexible walls.

Yet another embodiment of the present invention is shown generally in FIG. 8 and designated by the numeral 310. The wipes dispenser 310 includes a container 312 holding an interleaved stack of wipes 314 in the interior 316 of the container 312. The container 312 is a foil package having flexible walls 317 sealed together along a periphery 319. A raised portion 321 provides the rip fence 324, and the rip fence 324 can take any of the forms in accordance with the various teachings herein. The raised portion 321 can also carry the grip orifice 318, or the grip orifice 318 can be provided in the wall 317 at the area beneath the raised portion 321. All the various modifications disclosed above with respect to the other embodiments could be selectively practiced with respect to the embodiment of FIG. 8. The embodiment of FIG. 8 is shown mainly to describe how the concepts of the present invention could be provided in a flexible type container of wipes. When the wipes are wet wipes, the flexible container will typically be what is known in the art as a foil package.

In light of the foregoing it should be apparent that the present invention significantly advances the art of wipes dispensers by providing for separate grip orifice and rip fence elements. These elements will greatly reduce the instances of fallback and roping experienced in the prior art with respect to the dispensing orifices provided in the prior art. Although particular embodiments have been shown herein to disclose the concepts of this invention, this invention is not to be limited thereto or thereby. Instead, the claims will serve to define the scope of this invention.

What is claimed is:

1. A method for dispensing a lead wipe of a plurality of wipes from within a wipes dispenser, the method comprising:

(a) providing a wipes dispenser including:

a container having an interior holding a plurality of interconnected wipes interconnected by means selected from the group consisting of lines of perforation and interleaved connections, a grip orifice extending through a feed surface of the container, the grip orifice providing communication between the interior and the exterior of the container, a lead wipe of the plurality of interconnected wipes extending through the grip orifice to present a lead end of the lead wipe at the exterior of the container, and a rip fence separate and distinct from the grip orifice, the rip fence including:

a body member extending from the feed surface of the container at a location distanced from the grip orifice, and an aperture in the body member, the aperture defining a tear geometry, wherein the lead end of the lead wipe extends from the grip orifice, through the aperture;

(b) pulling on the lead end of the lead wipe to pull the lead wipe through the aperture in the body member and further to pull the lead wipe against the tear geometry at the point of interconnection of the lead wipe to a following wipe, said step of pulling thereby causing the remainder of the lead wipe to be removed from the container along with a lead end of the following wipe and further causing the lead wipe to be disassociated from the following wipe with the following wipe providing its lead end outside of said interior of said container.

2. The method of claim 1, wherein, in said step of providing, the rip fence of the wipes dispenser is pivotally secured to the feed surface so that the rip fence can pivot.

3. The method of claim 1, wherein the length of the lead end of the following wipe that is accessible for subsequent dispensing after said step of pulling is the distance between the grip orifice and the tear geometry of the rip fence when the lead wipe is disassociated from the following wipe.

4. The method of claim 1, wherein, after said step of pulling, the following wipe is held by the grip orifice and not by the rip fence.

5. A method for dispensing a lead wipe of a plurality of wipes from within a wipes dispenser, the method comprising:

(a) providing a wipes dispenser including:

a container having an interior holding a plurality of interconnected wipes interconnected by means selected from the group consisting of lines of perforation and interleaved connections, a grip orifice extending through a feed surface of the container, the grip orifice providing communication between the interior and the exterior of the container, a lead wipe of the plurality of interconnected wipes extending through the grip orifice to present a lead end of the lead wipe at the exterior of the container, and a rip fence separate and distinct from the grip orifice and pivotally secured to the feed surface, the rip fence including:

a body member extending from the feed surface of the container at a location distanced from the grip orifice, and an aperture in the body member, the aperture defining a tear geometry, wherein the lead end of the lead wipe extends from the grip orifice through the aperture;

(b) pulling on the lead end of the lead wipe to pull the lead wipe through the aperture in the body member and further to pull the lead wipe against the tear geometry at the point of interconnection of the lead wipe to a following wipe, said step of pulling thereby causing the remainder of the lead wipe to be removed from the container along with a lead end of the following wipe and further causing the lead wipe to be disassociated from the following wipe with the following wipe providing its lead end outside of said interior of said container, wherein in said step of pulling, the rip fence pivots according to a pressure point created by the contact between the lead wipe and the rip fence.

* * * * *